US006866534B2

(12) United States Patent
Hirschmann

(10) Patent No.: US 6,866,534 B2
(45) Date of Patent: Mar. 15, 2005

(54) ELECTRICAL PLUG CONNECTOR

(75) Inventor: Michael Hirschmann, Leingarten (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 10/462,798

(22) Filed: Jun. 17, 2003

(65) Prior Publication Data

US 2004/0127087 A1 Jul. 1, 2004

(30) Foreign Application Priority Data

Jun. 17, 2002 (DE) ..... 102 27 016

(51) Int. Cl.[7] ..... H01R 13/627
(52) U.S. Cl. ..... 439/352; 439/188
(58) Field of Search ..... 439/352, 488, 439/489, 188, 357, 358

(56) References Cited

U.S. PATENT DOCUMENTS 6,217,388 B1 * 4/2001 Francis ..... 439/620
6,276,953 B1 * 8/2001 Gauker et al. ..... 439/352
6,328,589 B1 * 12/2001 Annecke ..... 439/352
6,364,683 B1 * 4/2002 Kohno ..... 439/352
6,439,914 B2 * 8/2002 Nimura ..... 439/352
6,530,799 B2 * 3/2003 Regnier et al. ..... 439/352
6,699,059 B2 * 3/2004 Nagamine et al. ..... 439/352

FOREIGN PATENT DOCUMENTS

| | | |
|---|---|---|
| DE | 195 00 959 | 7/1996 |
| DE | 195 34 205 | 3/1997 |
| DE | 198 40 726 | 3/2000 |
| DE | 100 32 234 | 1/2002 |
| DE | 101 51 956 | 7/2002 |
| EP | 0 591 947 | 4/1994 |
| EP | 1 006 621 | 6/2000 |
| EP | 1 130 692 | 9/2001 |

* cited by examiner

*Primary Examiner*—Hien Yu
(74) *Attorney, Agent, or Firm*—Blank Rome LLP

(57) ABSTRACT

The invention concerns an electrical plug connector, in particular for use between a receptacle (ignitor) and an electrical control device for a restraint system in motor vehicles, by way of example an air bag.

11 Claims, 2 Drawing Sheets

Figure 1:
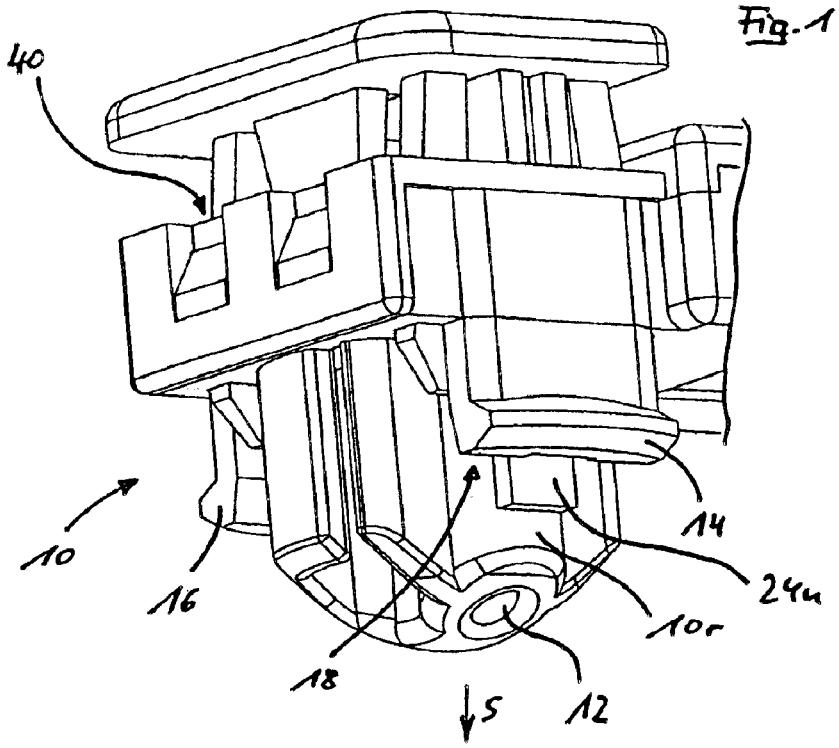

40
10
16
18
S
12
10r
24u
14

20
22c
30
22a
22
22d
22b
24p
34
28a
28
28g
28h
28s
26p
M
26
26u
32
24u
24

ELECTRICAL PLUG CONNECTOR

FIELD OF THE INVENTION

The invention concerns an electrical plug connector, in particular for use between a receptacle (ignitor) and an electrical control device for a restraint system in motor vehicles, by way of example an air bag.

BACKGROUND OF THE INVENTION

Plug connectors of this type are known by way of example from the following publications: EP 0 591 947 A2, DE 195 34 205 C2, DE 195 00 959 C2.

Such a plug connector has a tightly limited overall size (for example, length: 2 to 3 cm; width: approx. 1 cm; height: 0.1 to 1.0 cm). It follows from this that individual components of the plug connector and of the associated receptacle must be extremely small in size, though nevertheless in connection with the safety application (for example belt tensioner, airbag) easy assembly on the one hand and high functional reliability on the other hand are required.

This applies in particular with reference to a latching of plug and receptacle, with the contact elements of the components having to contact reliably in the locked state. In like manner, the plug and receptacle must not release from each other unintentionally.

With the aforementioned state of the art, this problem is solved in that the plug and the receptacle in a first work step are contacted and latched together and in a second work step a locking element is brought behind the catch arm of the plug as a so-called secondary locking in order to ensure latching against unintended release.

In the case of the plug connector according to DE 198 40 726 C2, the locking element can be preassembled, and in the preassembled starting position it lies in an elevated position against the effect of a spring. The plug connector and the receptacle can be latched against the effect of the spring.

SUMMARY OF THE INVENTION

With the present invention, an alternative structural shape for a plug connector is to be offered that fulfills the following requirements: A locking element for secondary locking of housing and receptacle should be capable of being preassembled. The locking element in the preassembled position should at a minimum facilitate the introduction of the plug connector (for example its corresponding housing section) into the receptacle. The locking element should then be brought into its end position opposite the housing of the plug connector in which it assumes the desired function of a secondary locking with respect to spring-acting catch arms.

The invention is based on the idea of configuring the locking element with various function arms, specifically:

with locking arms, and with spring arms, both of which extend out from a base portion of the locking element. The locking arms, as the name indicates, serve essentially as the secondary locking of the catch arms of the housing. They therefore can essentially be stiff and fulfill their function when they have been pushed in the plugging direction of the locking element so far that they extend into the area behind the corresponding catch arms of the housing.

The spring arms have a certain degree of elasticity, i.e., they can be brought into various positions with corresponding pretensioning or relieving of the pretensioning. One position (prior to assembly) should fix the locking element with respect to the housing. Through pressure on the locking element, the corresponding housing part is carried with it and can be inserted into the receptacle.

At the end of the path of movement, the spring arms, however, should release again with respect to the housing. The plug connector is then brought into the locking position with respect to the receptacle. But in addition there is a relative shift of the locking element and the housing (in the plugging direction) so that the locking element can be brought into its end position with respect to the housing. In this position, the locking arms also are situated behind the catch arms of the housing. In this position, a locking arm can also be used to cancel a shunt as will be explained below.

The movement sequence accordingly is in two steps:

First the locking element and housing are brought together in the preassembled position; then the locking element is released from the anchor position with respect to the housing and is shifted relative to it.

In its most general embodiment form, the invention accordingly concerns an electrical plug connector, in particular for use between a receptacle (ignitor) and an electrical control device for a restraint system in motor vehicles, with the following features:

- a housing for receiving electrically connected contact elements for contact with corresponding contact parts of the receptacle,
- spring-acting catch arms on the housing for fastening the housing to the receptacle,
- a locking element with
- locking arms which extend from a base portion of the locking element,
- the locking arms are configured such that they secure the catch arms against release when the housing is situated in the locking position with respect to the receptacle,
- spring arms that project from the base part in the same direction as the locking arms,
- the spring arms are configured such that in a preassembled starting position they rest against the housing in the plug direction and the housing can be plugged into the receptacle through pressure on the locking element but shortly before reaching the locking position with respect to the receptacle are released again from this position through running up on an interior surface of the receptacle.

The interior surface, which by way of example is configured as an oblique surface in the area of the receptacle (the oblique surface can likewise be configured on the spring arm), is preferably configured in the area of a separate insulating body that is inserted in the mostly metallic receptacle body. This creates the possibility of fitting the insulating body with high dimensional accuracy and thus of ensuring precise positioning of the housing of the plug connector in the receptacle.

This feature is also of importance if a shunt between contact pins is at the same time to be released through the locking element. The small overall size mentioned makes possible only short plug paths so that only in the case of optimal precision is optimal function and reliability attained. The manufacturer of the plug connector can precisely dimension the insulation body (insert).

The aforementioned arms (locking arms, spring arms) project from a common base part. According to one embodiment form, the spring arms are arranged at a distance from the catch arms. The spring arms in unloaded condition run at an angle not equal to 90° to the base part. In this case the angle between the outside surface of the spring arm and the lower side of the base part should be <90°. In other words, the spring arms in side view run, extending from the base part, in each case toward the outside.

The spring arms can be configured on their exterior surface turned toward the receptacle with an undercut (a bead-like depression). This undercut serves as a support surface on a corresponding shoulder in the area of the inner wall of the housing in order to set the aforementioned preassembly position. In this position, the locking element thus lies upon the housing shoulder. If the user presses on the base portion, it thus automatically carries the housing of the plug connector along. The recess can have a base that runs vertical to the direction of movement of the catch arms.

The spring arms can have configured at their free ends on the outside an oblique surface. This oblique surface serves as a run-on surface on a corresponding ramp that is arranged in the area of the receptacle. With the aid of this oblique surface/ramp, the locking element upon further plugging into the receptacle can be released again from the preassembly position. In other words: As a result of the spring arms running up in the area of the receptacle or of a receptacle insert, the spring arms are pressed "inward" under pretension and at the same time the undercut is released from its catch position with respect to the shoulder on the side of the housing so that a relative shifting of the locking element and the housing can then take place.

According to one embodiment form, the spring arms extend from sections of the base part lying opposite each other. By way of example, in the case of a rectangular base portion, the spring arms extend out in the area of two parallel sides. In unloaded condition, the intervening distance between spring arms lying opposite each other at their free ends can be greater than in the areas of the base portion, which results in a conically expanding geometry toward the bottom.

The spring arms by way of example are arranged such that their direction of movement upon being released from the preassembled starting position runs in the direction toward the locking arms. This includes embodiment forms in which the locking arms run essentially perpendicular to the spring arms, thus for example along parallel edge sections perpendicular to the parallel edge sections from which the spring elements extend.

One or more locking arms as well as one or more spring elements can be arranged on each side of the base portion. The arrangement of the spring arms outside of any connection to the catch arms increases the reliability of the device.

As a result of the geometric separation of the locking arms from the spring arms, the locking arms can serve not only as secondary locking of catch arms on the housing side, but also through a corresponding length they can at the same time be used to cancel out a shunt which is ordinarily arranged between the contact parts/contact elements of housing and receptacle.

Taking into consideration the above-mentioned features, an embodiment form can be realized in which the locking element has a rectangular base portion from which on each of two sides a locking arm extends perpendicularly and from which at the two remaining opposite sides sections one or two spring arms extend in the same direction, preferably obliquely, so that there is a greater intervening space at the free ends of spring elements lying opposite each other than in the area of the base portion. As a result of this oblique placement, the prelatching with respect to the housing of the plug connector can be carried out more easily, if appropriate also with initial tension. As soon as the locking element has run onto the corresponding section of the receptacle via the free ends of the spring arms, the spring arms can be swung into a more or less perpendicular orientation with respect to the base portion (under initial tension) with there of course being a reversible deformation of the spring arms.

Further features of the invention are found in the features of the subclaims as well as the other application papers.

BRIEF DESCRIPTION OF THE INVENTION

Figure 2:
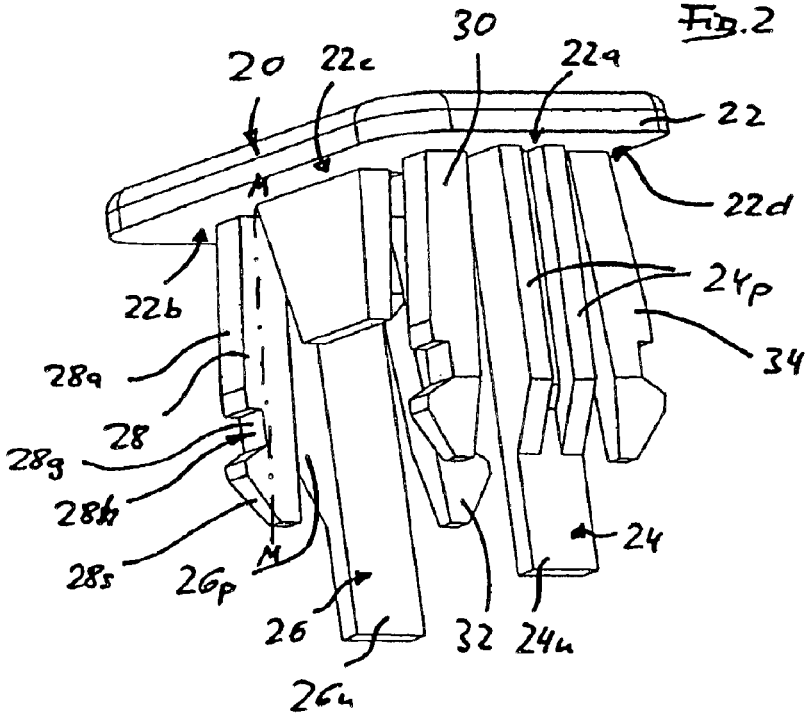

The invention will be explained in greater detail below on the basis of an exemplary embodiment, with drawings showing the following in schematic representation:

FIG. 1: shows a perspective partial view of a plug connector with inserted locking element, FIG. 2: shows a perspective view of the locking element according to FIG. 1.

Figure 3:
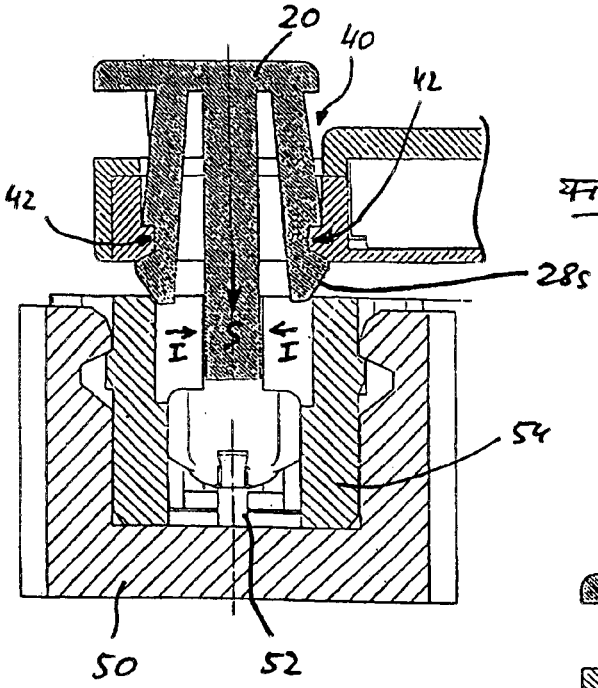

FIG. 3: shows a partial section presentation of a plug connector in relation to a receptacle in a first assembly stage.

Figure 4:
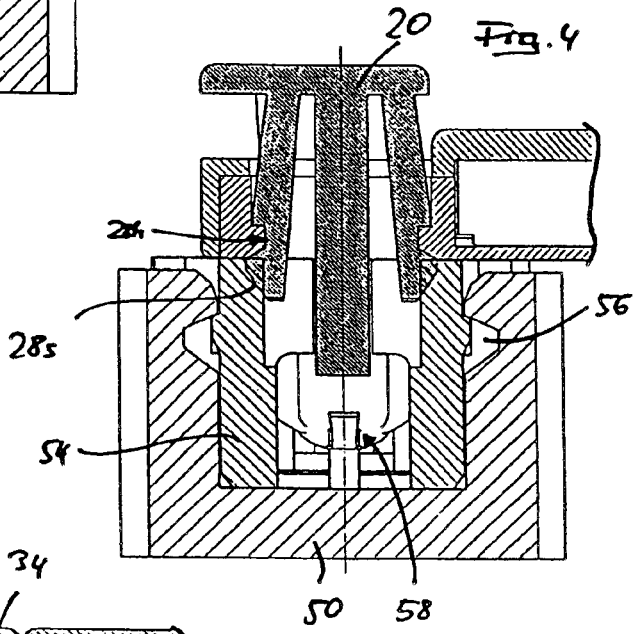

FIG. 4: shows a partial section presentation of a plug connector in relation to a receptacle in a second assembly stage.

Figure 5:
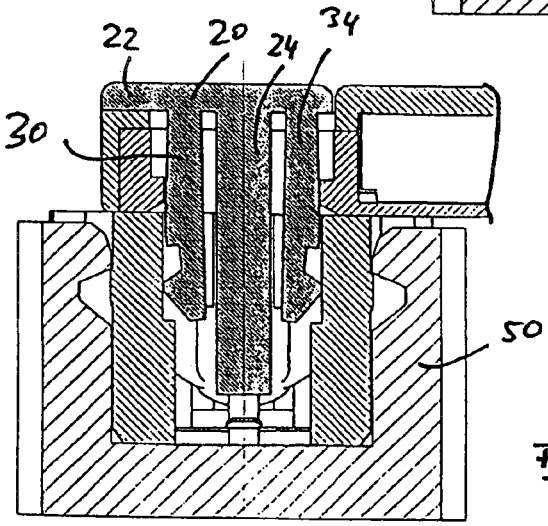

FIG. 5: shows a partial section presentation of a plug connector in relation to a receptacle in a third assembly stage (final locking position).

DETAILED DESCRIPTION OF THE PREFERRED EMBODIMENTS

In the figures the same components or components having the same effect are depicted with the same reference numbers.

The plug connector depicted in FIG. 1 corresponds with respect to its basic structure to that in accordance with DE 198 40 726 C2. To this extent, reference is made to said document. The plug connector accordingly in the side view is L-shaped, with in FIG. 1 essentially only one plug portion of housing 10 being depicted (which forms the shorter L leg). This housing portion essentially has a rectangular basic shape. In the plug direction S there are openings 12 in which contact springs (not depicted) are arranged that in locked conditions of plug and receptacle 50 contact corresponding contact pins 52 of a corresponding contact receptacle 50 (FIG. 3).

Also running in plug direction S are spring-acting catch arms 14, 16 from opposite sections of housing 10. All of these features are known from the plug connector described in DE 198 40 726 C2.

This also applies to the feature of a locking element 20 (FIG. 2) with respect to its principle function as a secondary locking for catch arms 14, 16.

In addition, locking element 20 with a rectangular base portion 22 possesses two locking arms 24, 26 which extend perpendicularly from oppositely situated side sections 22*a*, 22*b* of base portion 22. In order to fill out a space 18 between trunk-like housing section 10*r* and catch arms 14, 16 in the sense of an optimal secondary locking, locking arms 24, 26 in the upper portion (adjacent to base portion 22) are configured with profile strips 24*p*, 26*p* which extend outward while the respective lower sections 24*u*, 26*u* are configured plate-like and are parallel to the outer edges of sections 22*a*, 22*b* of base portion 22.

In FIG. 1, locking element 20 can be seen in partial engagement with housing 10. Also to be seen is lower section 24*u* of locking element 24 which in this plug position projects downward beyond corresponding catch arm 14.

Running essentially perpendicularly to locking arms 24, 26, in turn at oppositely situated sections 22*c*, 22*d* of the base portion are respectively two spring arms 28, 30, 32, 34 which are configured the same and will be explained using spring arm 28 as an example: Spring arm 28 extends from base portion 22 in the same direction as locking elements 24, 26, but not perpendicular but rather obliquely, with the angle between the lower face of base portion 22 and middle longitudinal axis M—M of spring arm 28 being around 80°. Along an exterior surface 28*a*, a bead-like depression 28*h* is formed through which a type of undercut is formed. Configured at the free end of spring arm 28 is an oblique surface 28*s* so that the end area of spring arm 28 is narrower than the section joined to the base portion 22.

FIG. 3 shows a first assembly stage: Locking element 20 is inserted into a corresponding opening 40 of housing portion 10, with this housing portion having a shoulder-like thickening 42 on the interior side at each of oppositely situated sections. Upon inserting locking element 20, its oblique surfaces (as 28*s*) first run up upon this shoulder 42, with it being swung toward the interior, and then it springs into the temporary locking position depicted in FIG. 3. This position represents a type of preassembly which can take place at the facilities of the manufacturer so that plug connectors and locking elements can be supplied to the customer jointly and in such manner that they cannot be lost.

For final assembly, the plug connector in the arrangement depicted in FIG. 3 is plugged further upon an associated receptacle with an insert 54 (insulation body) and through pressure is pressed onto locking element 20 in plug direction S. As this takes place, the oblique surfaces (such as 28*s*) of spring arms 28, 30, 32, 34 run upon corresponding oblique surfaces of insulating body 54 and in turn are pressed toward the interior (arrow direction I) so that they come through the position depicted in FIG. 4 into the end position depicted in FIG. 5 in which the plug connector is fully locked to the receptacle. The locking position is achieved on the one hand through contact pins 52 contacting the corresponding springs of the plug connector, through the springing in of catch arms 14, 16 into a corresponding encircling groove 56 of receptacle 50 (in FIGS. 3 through 5, this groove segment 56 runs parallel to the plane of the drawing), and this position finally is ensured through locking elements 24, 26 which are now located behind catch arms 14, 16.

As a result of the extended configuration of locking arms 24, 26 with their sections 24*u*, 26*u*, a shunt 58 running between contact pins 52 at the same time is released on the final path of locking element 20 into receptacle 50.

What is claimed is:

1. Electrical plug connector, in particular for use between a receptacle (ignitor) and an electrical control device for a restraint system in motor vehicles, with the following features:

a housing for receiving electrically connected contact elements for contacting corresponding contact parts of the receptacle, spring-acting catch arms on the housing for making the housing fastened to the receptacle;

a locking element with discrete locking arms which extend from a base portion of the locking element, the locking arms are configured such that the locking arms secure the catch arms against release when the housing is in a locked position with respect to the receptacle; and spring arms that extend from the base portion in the same direction as the locking elements, the spring arms are positioned on both sides of the spring-acting catch arms and the locking arms such that in a preassembled starting position the spring arms rest against the housing in the plug direction and the housing can be plugged into the receptacle through pressure on the locking element but shortly before reaching the locking position with respect to the receptacle the spring arms are released from the preassembled starting position again through running up onto an interior surface of the receptacle.

2. Plug connector according to claim 1 in which the spring arms in unloaded condition run at an angle to the base portion not equal to 90°.

3. Plug connector according to claim 1 in which the spring arms run at a distance to the catch arms.

4. Plug connector according to claim 1 in which the spring arms are configured on respective exterior surfaces turned towards the receptacle with a bead-like depression.

5. Plug connector according to claim 4 in which the bead-like depression has a base surface which runs perpendicular to a direction of movement of the catch arms.

6. Plug connector according to claim 1 in which free ends of the spring arms are configured on the outside with an oblique surface.

7. Plug connector according to claim 1 in which the spring arms extend from opposite sections of the base portion.

8. Plug connector according to claim 1 in which the distance of opposite spring arms in unloaded condition at their free ends is greater than in an area of the base portion.

9. Plug connector according to claim 1 in which the spring arms are configured such that upon releasing from the preassembled starting position the spring arms move in a direction towards the locking arms.

10. Plug connector according to claim 1 in which the locking arms extend from opposite sections of the base portion.

11. Plug connector according to claim 1 in which at least one locking arm has a length such that in the locked position of housing and receptacle, the at least one locking arm presents a shunt between the contact parts and contact elements.

* * * * *

UNITED STATES PATENT AND TRADEMARK OFFICE

CERTIFICATE OF CORRECTION

PATENT NO. : 6,866,534 B2
APPLICATION NO. : 10/462798
DATED : March 15, 2005
INVENTOR(S) : Michael Hirschmann It is certified that error appears in the above-identified patent and that said Letters Patent is hereby corrected as shown below:

In claim 1, col. 6, line 3, before "locking" (first instance), insert --discrete--; and delete "discrete" after "with".

Signed and Sealed this

Eighth Day of April, 2008

JON W. DUDAS
*Director of the United States Patent and Trademark Office*